United States Patent [19]

Deal

[11] Patent Number: 4,735,170

[45] Date of Patent: Apr. 5, 1988

[54] SPRAY SHIELD FOR A FACEPLATE PANEL

[75] Inventor: Samuel B. Deal, Lancaster, Pa.

[73] Assignee: RCA Corporation, Princeton, N.J.

[21] Appl. No.: 936,500

[22] Filed: Dec. 1, 1986

[51] Int. Cl.[4] ..... B05C 13/02

[52] U.S. Cl. ..... 118/505; 118/301

[58] Field of Search ..... 118/505, 301; 427/64, 427/68; 445/11, 47, 70

[56] References Cited

U.S. PATENT DOCUMENTS

| | | | |
|---|---|---|---|
| 2,831,455 | 4/1958 | Sadowsky | 118/505 |
| 2,953,483 | 9/1960 | Torok | 118/301 X |
| 3,423,621 | 1/1969 | Royce | 313/92 |
| 3,703,401 | 11/1972 | Deal et al. | 427/68 |
| 3,839,990 | 10/1974 | Nvehring | 118/301 X |
| 4,025,661 | 5/1977 | Moscony et al. | 427/68 |
| 4,125,088 | 11/1978 | Hong et al. | 118/301 |
| 4,623,820 | 11/1986 | Deal | 427/64 |

*Primary Examiner*—John E. Kittle
*Assistant Examiner*—Alain Bashore
*Attorney, Agent, or Firm*—Eugene M. Whitacre; Dennis H. Irlbeck

[57] ABSTRACT

A spray shield for a faceplate panel having a viewing widow and an integral peripheral panel sidewall which terminates in a seal land includes a gasket of a low durometer high temperature elastomer which envelopes the seal land for preventing pull-through of a spray coating. The shield and the gasket prevent the spray coating from being deposited on a predetermined portion of an interior sidewall portion of the panel and on the seal land. Since the gasket prevents pull-through of the spray coating, none of the spray coating is deposited on the exterior surface of the panel.

11 Claims, 2 Drawing Sheets

SPRAY SHIELD FOR A FACEPLATE PANEL

BACKGROUND OF THE INVENTION

The invention relates to a viewing screen structure formed on an interior surface of a cathode-ray tube (CRT) faceplate panel and, more particularly, to a spray shield which protects at least an interior surface portion and a seal land of the faceplate panel from a heat-absorptive overcoating sprayed on a highly reflective metal layer which overlies the viewing screen.

One type of cathode-ray tube that is used for television displays is referred to as a shadow-mask tube. This tube is comprised of an evacuated envelope having a viewing window, a viewing-screen structure comprised of a mosaic of phosphor areas (usually dots or strips) of different emission colors supported on the inner surface of the viewing window, a shadow mask having an array of apertures therein in register with the phosphor areas mounted in the tube in adjacent spaced relation with the window, and means for projecting one or more (usually three) electron beams towards the screen for selectively exciting the phosphor areas thereof.

In operating a shadow-mask tube, the electron beams are made to scan a raster in a fixed pattern. As the beams are made to scan, they are either intercepted by the mask or they pass through the mask apertures and excite the desired phosphor areas. The energy in the intercepted electron beams heats the mask and may cause the mask to become distorted, which may adversely affect the position of the beams which pass through the mask apertures. Some of the heat in the mask is removed by radiation back to a dark coating on the funnel of the tube. Normally, the viewing-screen structure includes a thin layer of a highly reflective metal, usually aluminum, which reflects heat that is radiated forward towards the screen.

U.S. Pat. No. 3,703,401 issued to S. B. Deal et al. on Nov. 21, 1972 and U.S. Pat. No. 4,025,661 issued to J. J. Moscony et al. on May 24, 1977 suggest applying to the reflective metal layer a water-based heat-absorptive overcoating of carbon particles. Then, the structure is baked to remove organic and volatile materials therefrom. The purpose of a heat-absorptive overcoating is to promote the transport of heat from the shadow mask to the atmosphere through the glass panel and thereby reduce mask warpage due to uneven heating of the mask-frame assembly of the tube. Common formulations used in applying these overcoatings include such constituents as finely-divided particles of graphite and lamp black together with dispersants and wetting agents.

The Deal et al. and Moscony et al. patents suggest air spraying the overcoating as well as an initial sealer coating or barrier layer which prevents carbon in the overcoating from penetrating through the aluminum metal layer into the phosphor mosaic. The patents also suggest the use of a suitable shield which is not described, to prevent the barrier layer and the overcoating from being sprayed on the inner sidewall of the panel and onto the seal land. It is necessary to prevent the coatings from contacting the seal land since contaminants on the seal land will adversely affect the quality of the subsequent frit seal which is required to attach the faceplate panel to the funnel portion of the tube.

In order to prevent the coatings from contaminating the seal land and from being deposited on the internal sidewall and the exterior surface of the panel it is necessary to preheat the panel in an oven to a panel temperature of about 75° C. to dry the water-based coatings sufficiently rapidly to maintain high production rates. To achieve such a panel temperature, the oven temperature must be about 135° C. At such a temperature the shield must be formed of a rigid plastic to maintain dimensional stability; however hard plastics provide poor sealing characteristics of the seal land and permit pull-through or leakage of the spray coating between the spray shield surface and the glass panel thereby depositing the spray coating on the interior sidewall of the panel and contaminating the seal land. Accordingly, a spray shield is required which prevents pull-through and thereby provides improved protection of the interior sidewall, the seal land and the exterior surface of the panel.

SUMMARY OF THE INVENTION

A spray shield for a faceplate panel comprises limiting means for restricting the spraying of an overcoating substantially to an aluminum layer on a phosphor screen formed on a viewing window of the panel. The shield also includes protecting means for preventing pull-through of the overcoating onto a seal land of the panel.

DETAILED DESCRIPTION OF THE PREFERRED EMBODIMENT

Figures 1, 5:
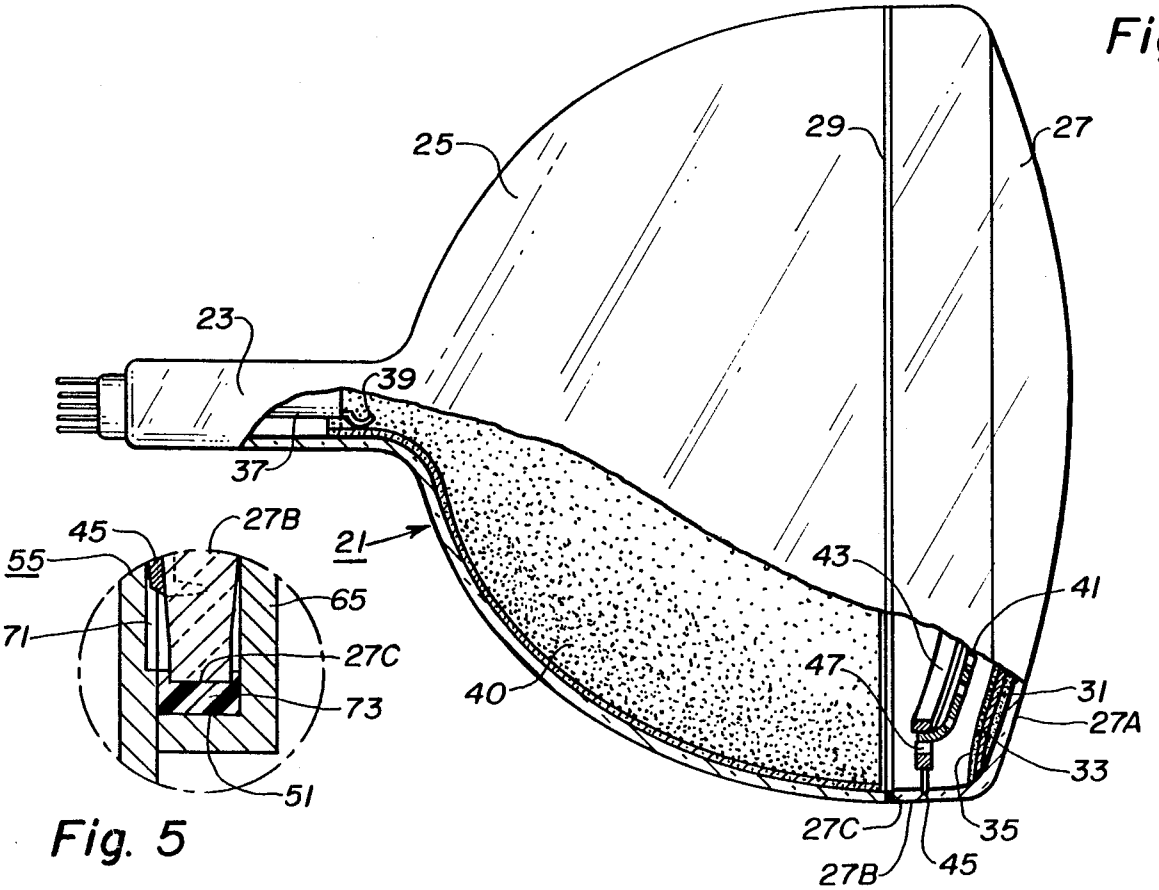
FIG. 1 is a partially broken-away longitudinal view of a CRT having a faceplate panel made using the present invention.
FIG. 5 shows an enlarged sectional view of the seal land of the faceplate plate within circle 5 of FIG. 4.

The CRT shown in FIG. 1 is an aperture-mask-type kinescope of the type described in U.S. Pat. No. 3,423,621 to M. R. Royce. The CRT includes an evacuated envelope 21, which includes a neck 23 integral with a funnel 25 and a faceplate panel 27. The faceplate panel 27 comprises a viewing window 27A and an integral peripheral sidewall 27B which terminates in a seal land 27C and which is joined to the funnel 25 by a seal 29 of devitrified glass. A luminescent viewing screen 31 comprising a mosaic of line or dot areas of different luminescent emission colors resides on the inner surface of the viewing window 27A. A light-reflecting metal layer 33 of aluminum resides on the screen 31, and a heat absorptive overcoating 35 resides on the metal layer 33. An electron-gun mount assembly 37 is located in the neck 23. A plurality of metal fingers 39 (only one of which is shown) space the mount assembly 37 from the neck wall and connect the mount assembly 37 to an internal conductive coating 40 on the inner surface of the funnel 25. Closely spaced from the metal layer 33 is a metal aperture mask 41. The mask 41 is welded to a metal frame 43 which is supported by springs 47 on studs 45 which are integral with the panel 27. An electron beam or beams from the mount assembly 37, when suitably scanned on the screen 31, is capable of producing a luminescent image which may be viewed through the window 27A.

Figure 2:
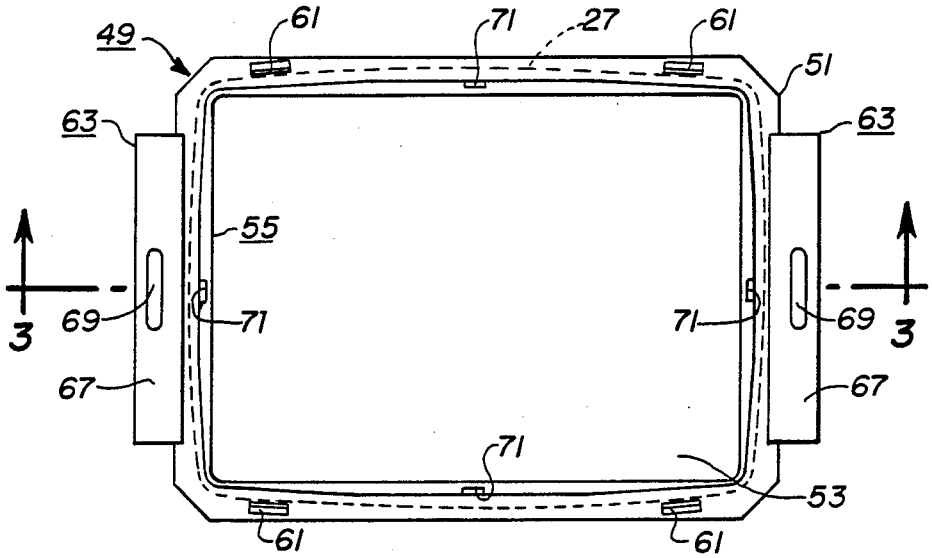
FIG. 2 shows a plan view of a novel panel spray shield.
Figure 3:
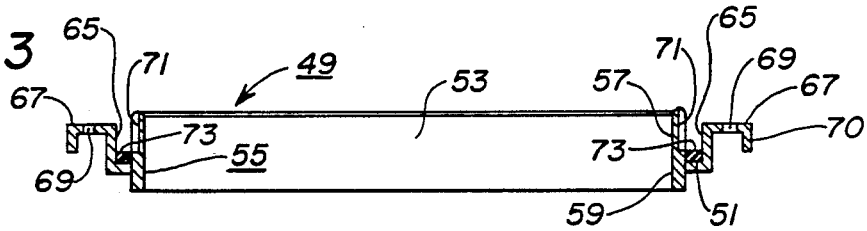
FIG. 3 is a sectional view taken along lines 3—3 of FIG. 2.
Figure 4:
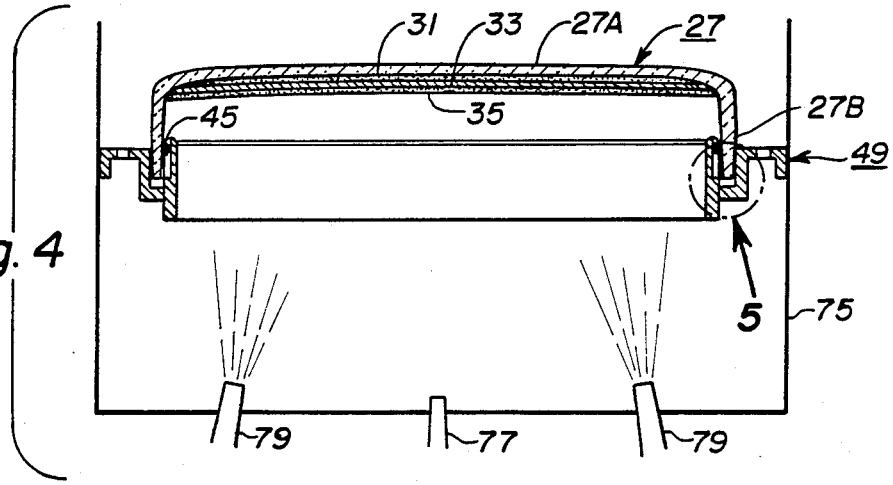
FIG. 4 is a schematic view of a faceplate panel mounted on the novel spray shield during a step in the manufacturing process.

The heat absorptive overcoating 35 may comprise any of the heat absorptive coatings described in U.S. Pat. Nos. 3,703,401; 4,025,661 (referenced herein) or in U.S. Pat. No. 4,623,820 issued to S. B. Deal et al. on Nov. 18, 1986. In order to apply the overcoating 35, a spray shield 49, as shown in FIGS. 2–4 is utilized to hold the faceplate panel 27. The spray shield 49 includes a substantially rectangular faceplate panel support surface 51 having a substantially rectangular, centrally disposed spray aperture 53 therethrough. A shield sidewall 55, provides spray limiting means around the inner periphery of the support surface 51 for restricting the spraying of the overcoating 35 substantially to the aluminum layer 33. The shield sidewall 55 is substantially orthogonal to the support surface 51 and extends above and below the support surface to provide both an upstanding shield portion 57 to contact and shield a predetermined portion of the interior surface of the peripheral sidewall 27B of the faceplate 27 from the direct impingement of overcoating 35 and a downward extending portion 59 to act as a base for the spray shield 49. The spray shield 49 further includes a plurality of L-shaped locating members 61 disposed along the long sides of the rectangular shield 49 to contact the outside edge of the faceplate panel 27 (shown by the dashed lines in FIG. 2) and to act as a first positioning means therefor. A pair of oppositely disposed handles 63 are integral with and located along the short sides of the spray shield 49. Preferably, each of the handles 63 includes an upstanding handle portion 65 that is substantially orthogonal to the support surface 51 and an outwardly extending handle portion 67 that is substantially orthogonal to the upstanding handle portion 65. A gripping aperture 69 is formed in each of the outwardly directed handle portions 67 and a downturned handle portion 70 may be included in the end thereof to facilitate handling the spray shield 49. The upstanding handle portions 65 in combination with the upstanding shield portion 57 of the shield sidewall 55 define a groove which acts as a second positions means for the faceplate panel 27. A plurality of stud accommodating slots 71 are formed in the outwardly facing surface of the upstanding shield portion 57 of the shield sidewall 55. Four slots 71 are provided to accommodate the faceplate studs 45; however, three slots may also be used to accommodate faceplates having only three studs. A gasket 73 of resilient material is disposed on the support surface 51 to provide a means for protecting the seal land 27C as described hereinafter.

The faceplate panel support surface 51, the shield sidewall 55 and the handle portions 65 of the spray shield 49 are formed from a material capable of maintaining its dimensional stability at a temperature of about 135° C. One suitable material is a polyurethane such as ADIPRENE L315 marketed by Uniroyal, Middlebury, CT, which is cured with MOCA (4—4′ methylenebis (2-chloroaniline)). The resultant material has a Shore hardness (durometer) of about 70 D. The gasket 73 of resilient material must also be capable of withstanding a temperature of about 135° C. One suitable material is a polyurethane such as VIBRATHANE 6007 cured with MOCA and marketed by Uniroyal, Middlebury, CT, which forms a low durometer high temperature elastomer having a Shore hardness of 57A durometer. Such a gasket material is substantially softer than the polyurethane used to form the support surface 51, shield sidewall 55 and handle portions 65 of the spray shield 49 and permits the seal land 27C of the faceplate panel 27 to be enveloped thereby, as shown in FIG. 5. The polyurethane material used to form the gasket 73 is bonded to the support surface 51 by cross-linking of the similar polymers.

GENERAL CONDITIONS

The novel spray shield 49 having the soft gasket 73 provides superior shield performance by preventing pull-through of the overcoating material which in the prior art resulted in contamination of the interior surface of the sidewall 27B, the seal land 27C and the exterior surface of the faceplate panel 27. The overcoating 35 and a barrier coating (not shown) are deposited on the aluminum metal layer 33 overlying the viewing screen 31 by spray application.

The panel 27 with the intermediate screen structure thereon is placed upon the novel spray shield 49 so that the upstanding shield portion 57 of the sidewall 55 contacts and shields from direct impingement of the sprayed material the inner peripheral sidewall 27B of the panel 27 at about the mold match line so as to leave the entire viewing area of the screen 31 unmasked. With the panel 27 disposed on the spray shield 49 as described, the panel seal land 27C is embedded in the spray shield gasket 73. The panel and the spray shield are then loaded on a panel preheat oven feed conveyor (not shown). The panel and spray shield are passed through an automatic indexing oven (not shown) which is adjusted to a temperature of about 135° C. to provide a panel temperature, at spraying, of about 70° C. to 85° C. The panel and spray shield are removed from the oven, and transported to a spray booth 75 shown schematically in FIG. 4. A plurality of air spray guns 77 and 79 are provided in the booth 75. With the panel 27 still preheated, an aqueous dispersion of a volatilizable film-forming material is sprayed from spray gun 77 upon the unmasked aluminum metal layer 33 to form a barrier layer (not shown). A preferred dispersion that is substantially free from substances which, when incinerated, yield metal-ion-containing residues is prepared by mixing 250 milliliters of an aqueous acrylic resin emulsion (containing about 46-weight-percent solids) and 14 grams PVP (polyvinyl pyrolidone) with 2050 milliliters deionized water. A preferred acrylic resin emulsion is RHOPLEX AC-234 marketed by Rohm and Haas Company, Philadelphia, PA, which is believed to be constituted principally of ethyl acrylate copolymerized with minor amounts of acrylic and methacrylic monomers and polymers. The spraying is conducted for about 5 seconds with an air-spray gun operating at about 50-pounds-per-square-inch pressure, and includes about five passes of the spray across the surface. The sprayed material dries in less than 5 seconds, due in part to the heat in the preheated panel, forming the sealer coating or barrier layer. As shown in FIG. 5, the gasket 73 envelopes the seal land 27C and prevents pull-through of the sprayed material onto the interior surface portion of the sidewall 27B, the seal land 27C and the exterior surface of the panel 27.

Then, with the panel still preheated above 70° C., and the shield in place, a mixed suspension comprising particles of silica, graphite and carbon black is sprayed upon the unmasked portions of the coated metal layer. The spraying is conducted for about 20 seconds with the air-spray guns 79 operating at about 50 pounds-per-square-inch pressure and includes about twenty passes of the spray across the surface to provide a coating weight of about 0.15 mg/cm$^2$. The sprayed material dries in less than 30 seconds due in part to the heat in the preheated panel, and forms the heat-absorptive overcoating 35. The gasket 73 prevents pull-through of the subsequently sprayed material and thereby protects the interior surface portion of the sidewall, the seal land and the exterior surface of the panel from the overcoating 35.

The shield is removed, and the coated panel is now processed in the usual way. This includes the usual step of baking the panel in air at about 400° to 450° C. to remove, by vaporization and oxidation, the volatile and organic matter in the structure. In this last baking step, the film and coating of volatilizable material underlying and overlying the aluminum metal layer, the binders in the mosaic viewing screen, and all of the dispersing agents and wetting agents in the structure are removed. After baking, the structure includes an aluminum-metal reflective layer 33 on the phosphor mosaic viewing screen 31 and a heat-absorptive silica-and-carbon-and-graphite overcoating 35 adhered upon the aluminum layer.

What is claimed is:

1. A spray shield for a cathode-ray tube faceplate panel having a viewing window and an integral peripheral panel sidewall terminating in a seal land with a plurality of studs embedded in said panel sidewall, said faceplate panel having an exterior surface and an interior surface with a phosphor screen formed on the interior surface of said viewing window and an aluminum layer formed on said phosphor screen, said spray shield comprising a substantially rectangular faceplate panel support surface having a centrally disposed aperture therethrough, limiting means for restricting the spraying of a heat absorptive overcoating substantially to said aluminum layer and protecting means for preventing pull-through of said overcoating onto a predetermined portion of the interior surface of said panel sidewall, onto the seal land, and onto said exterior surface of said panel, said limiting means including a substantially orthogonal shield sidewall extending at least above said panel support surface along an inner periphery thereof for contacting and shielding said predetermined portion of said interior surface of said panel sidewall from direct impingement of said overcoating, and said protecting means including a gasket of resilient material disposed on said panel support surface for contacting and enveloping said seal land.

2. The spray shield described in claim 1, wherein said panel support surface of said said spray shield includes a groove into which said resilient material is disposed.

3. The spray shield described in claim 1, further including locating means for positioning said faceplate panel on said panel support surface.

4. The spray shield described in claim 1, wherein a plurality of stud accommodating means are formed in said shield sidewall to facilitate positioning said faceplate panel on said spray shield, said stud accommodating means having a depth less than the thickness of said shield sidewall.

5. The spray shield as described in claim 1, wherein said panel support surface and said shield sidewall are formed of a hard material capable of maintaining dimensional stability at a temperature of about 135° C.

6. The spray shield as described in claim 5 wherein said hard material comprises a polyurethane having a Shore hardness of about 70D.

7. The spray shield as described in claim 6 wherein said resilient material comprises a low durometer high temperature elastomer.

8. The spray shield as described in claim 7 wherein said low durometer high temperature elastomer is a polyurethane having a Shore hardness of about 57A.

9. The spray shield as described in claim 7 wherein said resilient material is cross-link bonded to said hard polyurethane of said panel support surface.

10. The spray shield as described in claim 1, wherein said orthogonal shield sidewall extends below said panel support surface to form a spray shield base.

11. The spray shield as described in claim 1, further including a pair of oppositely disposed handles extending from said panel support surface.

* * * * *